US006439430B1

(12) United States Patent
Gilroy, Sr. et al.

(10) Patent No.: US 6,439,430 B1
(45) Date of Patent: Aug. 27, 2002

(54) COLLAPSIBLE BAG, AEROSOL CONTAINER INCORPORATING SAME AND METHOD OF ASSEMBLING AEROSOL CONTAINER

(75) Inventors: Gordon C. Gilroy, Sr., Concord; Jeremy P. Smith, Loudon, both of NH (US)

(73) Assignee: Summit Packaging Systems, Inc., Manchester, NH (US)

( * ) Notice: Subject to any disclaimer, the term of this patent is extended or adjusted under 35 U.S.C. 154(b) by 0 days.

(21) Appl. No.: 09/668,402

(22) Filed: Sep. 22, 2000

(51) Int. Cl.[7] ..... B65D 83/14
(52) U.S. Cl. ..... 222/95; 222/105; 222/402.1
(58) Field of Search ..... 222/95, 105, 107, 222/212, 214, 215, 402.1, 402.24, 389

(56) References Cited

U.S. PATENT DOCUMENTS

| | | | | |
|---|---|---|---|---|
| 2,671,578 A | | 3/1954 | McBean | 222/95 |
| 2,816,691 A | | 12/1957 | Ward | 222/183 |
| 2,937,791 A | | 5/1960 | Micallef | 222/95 |
| 3,040,933 A | | 6/1962 | Everett | 222/95 |
| 3,169,670 A | | 2/1965 | Hrebenak et al. | 222/95 |
| 3,223,289 A | | 12/1965 | Bouet | 222/209 |
| 3,323,206 A | | 6/1967 | Clark | 29/509 |
| 3,378,169 A | | 4/1968 | Clark | 222/95 |
| 3,662,926 A | | 5/1972 | Umstead | 222/95 |
| 3,669,313 A | | 6/1972 | Marand et al. | 222/95 |
| 3,731,854 A | | 5/1973 | Casey | 222/386.5 |
| 3,828,977 A | | 8/1974 | Borchert | 222/95 |
| 3,905,517 A | | 9/1975 | Friedrich et al. | 222/95 |
| 3,938,708 A | | 2/1976 | Burger | 222/95 |
| 3,940,026 A | * | 2/1976 | Kain | 222/215 |
| 3,976,223 A | | 8/1976 | Jass et al. | 222/94 |
| 3,979,025 A | | 9/1976 | Friedrich et al. | 222/95 |
| 4,032,064 A | | 6/1977 | Giggard | 229/55 |

(List continued on next page.)

*Primary Examiner*—Kenneth Bomberg
(74) *Attorney, Agent, or Firm*—Davis & Bujold, P.L.L.C.

(57) ABSTRACT

An improved collapsible bag for containing a product to be dispensed from an aerosol container. The improved collapsible bag has an opening at one end and is closed at an opposite end and comprises an upper section, a mid-section and a lower section. The upper section includes a neck portion, a curl portion and an outwardly tapering section. The mid-section, in an inflated state of the collapsible bag, is generally cylindrical in shape and is contiguous with the outwardly tapering section. The lower section tapers inwardly and defines the closed end of the improved collapsible bag and the lower section is contiguous with the mid-section. At least the curl portion of the upper section has a sufficient wall thickness to facilitate a fluid tight seal between a bead of a container and a perimeter curl of a mounting cup, during assembly of an aerosol valve, while a remainder of the upper section, the mid-section and the lower section all have a sufficiently thin wall thickness to facilitate collapse and substantially complete dispensing of the product to be dispensed from the improved collapsible bag.

12 Claims, 4 Drawing Sheets

U.S. PATENT DOCUMENTS 4,039,103 A 8/1977 Juillet ..... 222/95
4,045,860 A 9/1977 Winckler ..... 29/451
4,062,475 A 12/1977 Harris et al. ..... 222/95
4,066,596 A 1/1978 Stern ..... 260/29.6 R
4,095,724 A 6/1978 Perusco ..... 222/95
4,117,951 A 10/1978 Winckler ..... 220/461
4,121,737 A 10/1978 Kain ..... 222/95
4,136,802 A 1/1979 Mascia et al. ..... 222/95
4,148,416 A 4/1979 Gunn-Smith ..... 222/94
4,150,522 A 4/1979 Burger ..... 53/470
4,153,182 A 5/1979 Loeliger ..... 222/95
4,189,069 A 2/1980 Stoody ..... 222/83.5
4,198,365 A 4/1980 Pelton ..... 264/249
4,238,264 A 12/1980 Pelton ..... 156/212
4,293,353 A 10/1981 Pelton et al. ..... 156/69
4,324,350 A 4/1982 Thompson ..... 222/212
4,383,399 A 5/1983 Stoody ..... 53/470
4,387,833 A 6/1983 Venus, Jr. ..... 222/95
4,441,632 A 4/1984 Stoody ..... 222/129
4,457,454 A 7/1984 Meshberg ..... 222/95
4,949,871 A 8/1990 Flanner ..... 222/95
4,953,753 A 9/1990 Gortz ..... 222/105
4,964,540 A 10/1990 Katz ..... 222/95
4,969,577 A 11/1990 Werding ..... 222/94
4,981,238 A 1/1991 Wenmaekers ..... 222/103
5,007,556 A 4/1991 Lover ..... 222/386.5
5,031,384 A 7/1991 Rebeyrolle et al. ..... 53/452
5,069,363 A 12/1991 Daimler ..... 222/95
5,111,971 A 5/1992 Winer ..... 222/95
5,115,944 A 5/1992 Nikolich ..... 222/94
5,123,571 A 6/1992 Rebeyrolle et al. ..... 222/105
5,135,137 A 8/1992 Rudick ..... 222/1
5,137,179 A 8/1992 Stoffel ..... 222/95
5,143,260 A 9/1992 Loychuk ..... 222/95
5,169,037 A 12/1992 Davies et al. ..... 222/402.1
5,179,982 A 1/1993 Bérubé et al. ..... 141/20
5,186,361 A 2/1993 Williams ..... 222/95
5,211,316 A 5/1993 Adalberto et al. ..... 222/386.5
5,217,139 A 6/1993 Miczka et al. ..... 220/404
5,232,126 A 8/1993 Winer ..... 222/95
5,238,150 A 8/1993 Williams ..... 222/95
5,248,063 A 9/1993 Abbott ..... 222/95
5,265,765 A * 11/1993 Maier ..... 222/105
5,277,336 A 1/1994 Youel ..... 222/105
5,282,549 A 2/1994 Scholz et al. ..... 222/95
5,292,033 A 3/1994 Gueret ..... 222/95
5,320,255 A 6/1994 Stoffel et al. ..... 222/212
5,343,901 A 9/1994 Meshberg ..... 141/2
5,353,962 A 10/1994 Scholz et al. ..... 222/95
5,370,272 A 12/1994 Gueret ..... 222/95
5,409,142 A 4/1995 Wenmaekers et al. ..... 222/95
5,477,985 A 12/1995 Gueret ..... 222/107
5,505,039 A 4/1996 Maier ..... 53/432
5,522,526 A 6/1996 DeLaforcade et al. ..... 222/1
5,622,282 A 4/1997 Yazawa et al. ..... 222/95
RE35,540 E 6/1997 Davies et al. ..... 222/402.1
5,685,456 A 11/1997 Goldstein ..... 222/95
5,730,326 A 3/1998 Kaeser ..... 222/95
5,730,328 A 3/1998 Maeder et al. ..... 222/95
5,772,083 A 6/1998 Joulla ..... 222/396
5,848,623 A 12/1998 Ueda ..... 141/64
5,915,595 A 6/1999 Dow et al. ..... 222/95
5,921,439 A 7/1999 Losenno et al. ..... 222/95
5,927,551 A 7/1999 Taylor et al. ..... 222/95
5,957,333 A 9/1999 Losenno et al. ..... 222/95
5,979,707 A 11/1999 Bodin et al. ..... 222/95
6,073,804 A 6/2000 Yquel ..... 222/95
6,098,864 A * 8/2000 Yazawa et al. ..... 222/95
6,196,275 B1 3/2001 Yazawa et al. ..... 141/3
6,230,943 B1 5/2001 Miyamoto et al. ..... 222/934

* cited by examiner

COLLAPSIBLE BAG, AEROSOL CONTAINER INCORPORATING SAME AND METHOD OF ASSEMBLING AEROSOL CONTAINER

FIELD OF THE INVENTION

The present invention relates to an improved collapsible bag for dispensing a product to be dispensed from an aerosol container, an aerosol container utilizing the improved collapsible bag in which a perimeter portion of the collapsible bag is sandwiched between a container bead and a mounting cup, of the aerosol container, to form a fluid tight seal therebetween, and a method of assembling an aerosol container with the improved collapsible bag located therein.

BACKGROUND OF THE INVENTION

Currently on the market, there are a variety of aerosol containers which facilitate dispensing of a desired product in a desired manner. Some of these currently available prior art aerosol containers relate to arrangements which separate the product to be dispensed from the propellant. While such product to be dispensed/propellant separation is known, the currently available systems tend to be somewhat costly to manufacture and assemble and such systems do not minimize consumption of raw materials. Further, the assembly of the dispensing container, with separate dispensing and propellant compartments, have associated drawbacks which prevent efficient manufacture and assembly of such aerosol containers.

One current problem associated with manufacturing an aerosol container having a bag, containing and separating the product to be dispensed from the propellant, is that the bag is manufactured from nylon and is typically supplied to the manufacturing facility in a folded/deflated state. Accordingly, the bag must be steamed, prior to use, to soften the nylon so that the bag will be somewhat relatively easy to be received within the opening defined by the bead of the aerosol container. This additional steaming process step increases the manufacturing costs associated with manufacturing the aerosol container and decreases the associated production time for manufacturing the aerosol container.

Another associated drawback is that the typical accordion-style liner or bag is incorporated into a specially manufactured container which is then combined with a valve assembly and mounting cup to complete assembly of the container. However, as this container is specially manufactured, it is generally fairly costly, in comparison to other aerosol containers, to manufacture and such speciality item leads to increased production costs in the manufacture of the aerosol container for dispensing the product to be dispensed.

SUMMARY OF THE INVENTION

Wherefore, it is an object of the present invention to overcome the above mentioned shortcomings and drawbacks associated with the prior art collapsible bag and aerosol containers incorporating the same.

It is an object of the present invention to provide an improved collapsible bag which minimizes the consumption of raw materials and facilitates essentially complete dispensing of the product to be dispensed from the improved collapsible bag.

Another further object of the present invention is to provide an improved curl portion which facilitates an improved seal between the bead of the aerosol container and the mounting cup during the assembly process.

A still further object of the present invention is to provide an improved collapsible bag which is readily received within an opening, defined by a bead of the aerosol container, without requiring a steaming step. The elimination of a processing step facilitates quicker assembly and manufacture of the aerosol container incorporating the improved collapsible bag according to the present invention.

Another object of the present invention is to streamline the manufacturing process of an aerosol container, having a bag separating the product to be dispensed from the propellant, to thereby reduce the associated manufacturing costs and production time in producing the aerosol container.

A further object of the present invention is to eliminate any steaming or other pretreatment procedure of the bag, prior to use, to simplify the manufacturing process for the aerosol container.

A still further object of the present invention is to provide an improved filling process for pressurizing the aerosol container with a desired propellant to facilitate dispensing of the product to be dispensed from the improved collapsible bag.

Yet another object of the present invention is to provide a small radius transition, located between the neck portion and a remainder of the upper section of the improved collapsible bag, to promote expansion of a side wall of the improved collapsible bag when the improved collapsible bag is filled with a desired product to be dispensed.

The present invention relates to a improved collapsible bag for containing a product to be dispensed from an aerosol container, the improved collapsible bag having an opening at one end and being closed at an opposite end, the improved collapsible bag comprising: an upper section including a neck portion, a curl portion and an outwardly tapering section; a mid-section being contiguous with the outwardly tapering section, and the mid-section being generally cylindrical in shape; a lower section being contiguous with the mid-section and defining the closed end of the improved collapsible bag, and the lower section tapering inwardly in an inflated state of the improved collapsible bag; and at least the curl portion having a sufficient wall thickness to facilitate a fluid tight seal between a bead and a perimeter curl of a mounting cup, during assembly of an aerosol valve, while a remainder of the upper section, the mid-section and the lower section all have a sufficiently thin wall thickness to facilitate collapse and substantially complete dispensing of the product to be dispensed from the improved collapsible bag.

The present invention also relates to an aerosol valve comprising an actuator assembly supporting an actuator button, the actuator assembly being crimped to a mounting cup, and the mounting cup, supporting the actuator assembly and the actuator button, being crimped to a bead of the aerosol container to form the aerosol container; an improved collapsible bag for containing a product to be dispensed from the aerosol container, the improved collapsible bag having an opening at one end and being closed at an opposite end, the improved collapsible bag comprising: an upper section including a neck portion, a curl portion and an outwardly tapering section; a mid-section being contiguous with the outwardly tapering section, and the mid-section being generally cylindrical in shape; a lower section being contiguous with the mid-section and defining the closed end of the improved collapsible bag, and the lower section tapering inwardly in an inflated state of the improved collapsible bag; and at least the curl portion having a sufficient wall thickness to facilitate a fluid tight seal between a bead and a perimeter curl of a mounting cup, during assembly of an aerosol valve, while a remainder of the upper section, the mid-section and the lower section all have a sufficiently thin wall thickness to facilitate collapse and substantially complete dispensing of the product to be dispensed from the improved collapsible bag; and the curl portion of the improved collapsible bag being located between the mounting cup and the bead to permanently secure the improved collapsible bag to the aerosol valve and form a fluid tight seal between the mounting cup and the bead.

Finally, the present invention relates to a method of forming an improved collapsible bag for containing a product to be dispensed from an aerosol container, the method comprising the steps of: forming the improved collapsible bag with an opening at one end and being closed at an opposite end; forming an upper section with a neck portion, a curl portion and an outwardly tapering section; connecting a mid-section to be contiguous with the outwardly tapering section of the upper section, and the mid-section being generally cylindrical in shape; connecting a lower section to be contiguous with the mid-section and the lower section defining the closed end of the improved collapsible bag, and the lower section tapering inwardly in an inflated state of the improved collapsible bag; and forming at least the curl portion with a sufficient wall thickness to facilitate a fluid tight seal between a bead and a perimeter curl of a mounting cup, during assembly of an aerosol valve, while a remainder of the upper section, the mid-section and the lower section all have a sufficiently thin wall thickness to facilitate collapse and substantially complete dispensing of the product to be dispensed from the improved collapsible bag.

BRIEF DESCRIPTION OF THE DRAWINGS

The invention will now be described, by way of example, with reference to the accompanying drawings in which.

DESCRIPTION OF THE PREFERRED EMBODIMENTS

Initially a detailed discussion concerning the improved collapsible bag, according to the present invention, will be provided. This discussion will then be followed by a detailed description concerning an aerosol container 30 incorporating the improved collapsible bag as well as a method of manufacturing the same.

Figure 1:
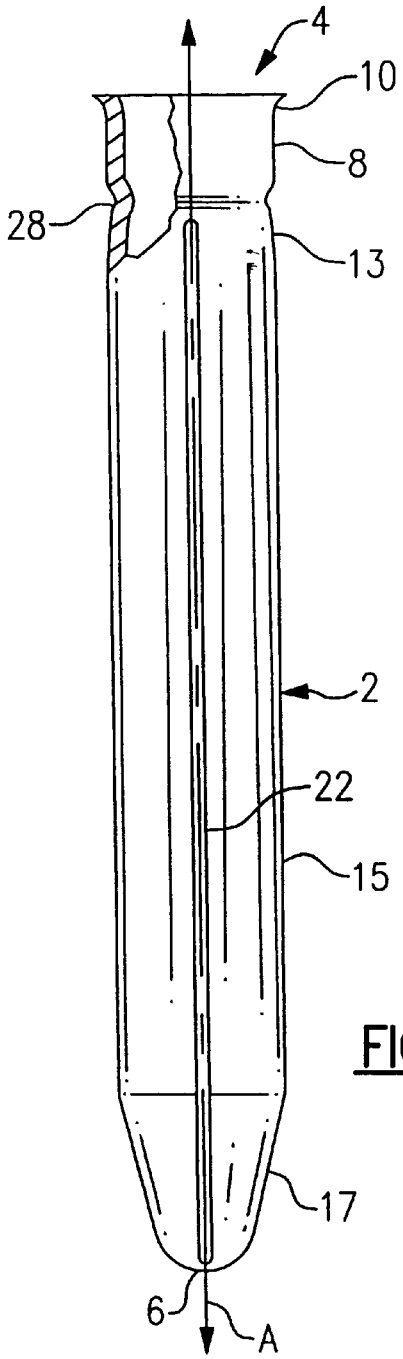
FIG. 1 is a diagrammatic front elevational view of the improved collapsible bag, according to the present invention, shown in its originally molded deflated state.
Figure 2:
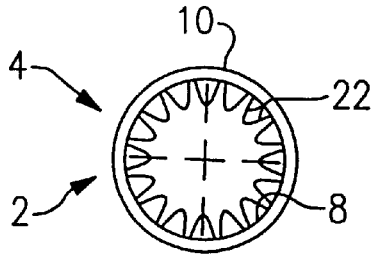
FIG. 2 is a top plan view of FIG. 1.
Figure 3:
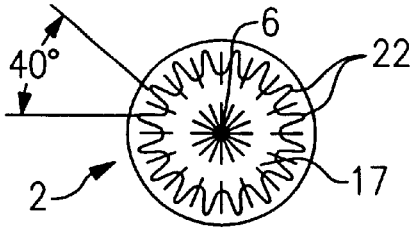
FIG. 3 is a bottom plan view of FIG. 1.
Figure 4:
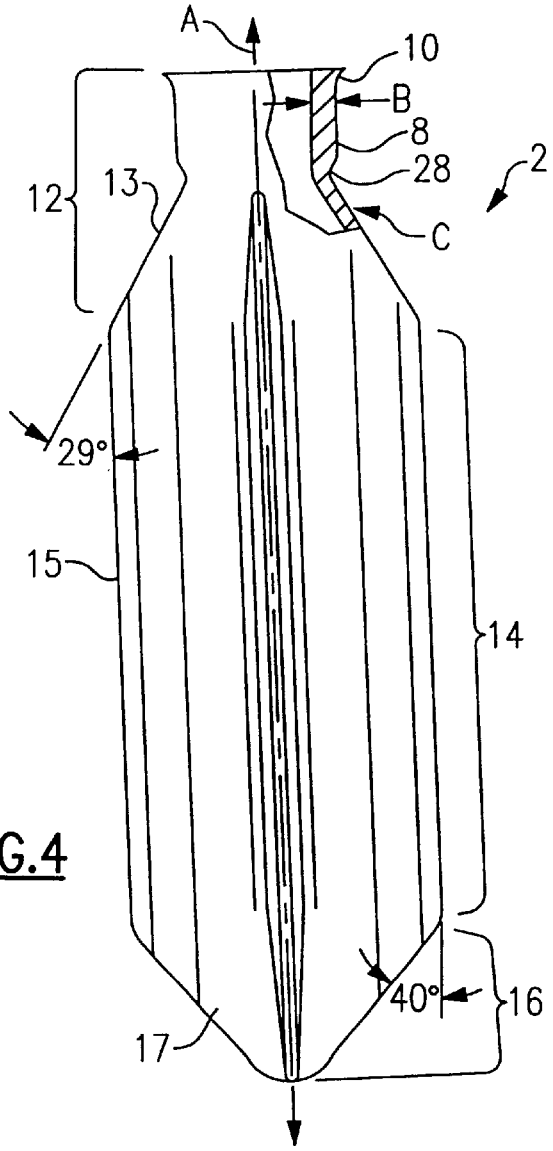
FIG. 4 is a diagrammatic front elevation view of the improved collapsible bag, according to the present invention, shown in its inflated state and containing a desired quantity of the product to be dispensed.
Figure 9:
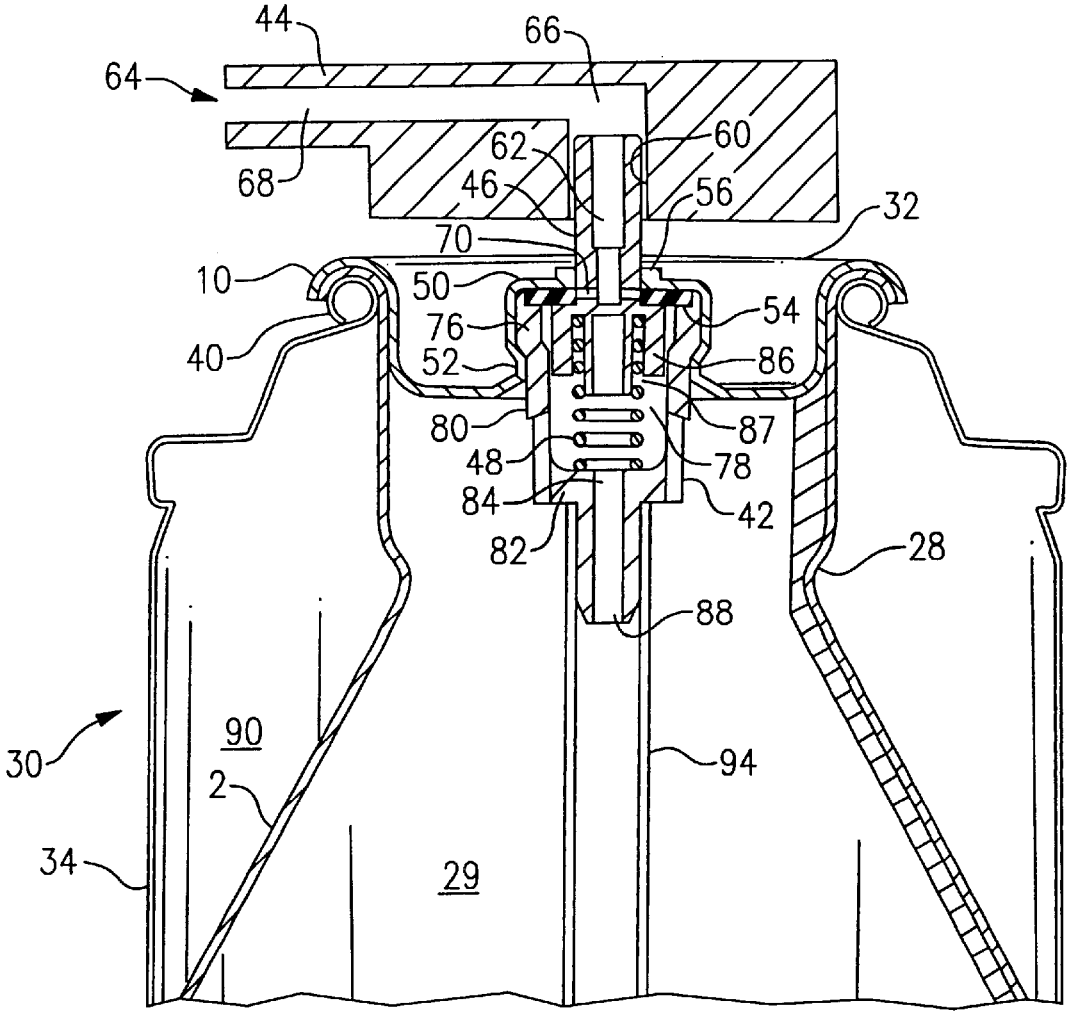
FIG. 9 is an enlarged diagrammatic partial cross-sectional view showing the bead, the mounting cup, the actuator valve and the spray actuator of the aerosol container.

With reference now to FIGS. 1–6 and 9, and initially FIGS. 1–3, the various features of the inflatable collapsible bag 2 can be discerned. As can be seen in these Figures, the improved collapsible bag is generally designated as element 2 and has an opening at a first end 4 thereof and is closed at an opposite end 6. As can be seen in FIGS. 1, 4 and 9, the opening of the improved collapsible bag is defined by a neck portion 8 which includes a perimeter curl portion 10 with an outwardly flaring exterior surface which is contoured to closely follow the exterior profile or contour of a bead 40, of an aerosol container 30, and be sandwiched between the bead 40 and the inwardly facing surface of the curl of a mounting cup (see FIG. 9) during manufacture of the aerosol product. A further detailed description concerning this sandwiching feature will follow below.

The improved collapsible bag 2 generally comprises an upper section 12 (see FIG. 4), which includes the neck portion 8, the curl portion 10, and an outwardly tapering 4D region 13 which tapers outwardly in the inflated state of the improved collapsible bag 2, a mid-section 14 which is generally cylindrical in shape in both the deflated and inflated states of the improved collapsible bag 2, and a lower section 16 which tapers inwardly, in the inflated state of improved collapsible bag 2, and forms the closed end 6 of the improved collapsible bag 2.

The preferred wall thickness dimensions for the neck 8 is on the order of between 0.010 and 0.030 inch, and most preferably about 0.015 inch. A remainder of the sidewall of the upper section 12, the mid-section 14 and the lower section 16 all have a substantially uniform and constant wall thickness of between 0.005 and 0.025 inch, and most preferably a wall thickness of about 0.006 inch. As can be seen in FIGS. 1, 4 and 9, there is a gradual transition in the wall thickness from the wall thickness of the curl portion 10 and neck portion 8 to the thinner wall thickness of the remaining portion of the upper wall section 12. This gradual transition occurs at a small radius transition 28.

The axial length of the improved collapsible bag 2, in the deflated state, is between 3 and 8 inches, and most preferably about 7.56 inches while the diameter of the improved collapsible bag 2, in the deflated state, is between 0.5 and 1.0 inch, and most preferably about 0.875 inch. The axial length of the neck portion 8 is between 0.5 and 1.0 inch, and most preferably about 0.69 inch. Preferably the improved collapsible bag 2 is manufactured from a resilient, durable, readily expandable material such as nylon, polyethylene, polytetraethylene or any other conventional material which is typically used for molding flexible components.

An important aspect of the improved collapsible bag 2 is that the neck portion 8 must have a sufficiently small outer diameter to be readily received within an opening defined by the bead 40 of an aerosol container 30 while the curl portion 10 must be of a sufficient large diameter to adequately engage with and sufficiently overlap the curl of the bead 40 of the aerosol container 30 and thereby adequately support and seal the improved collapsible bag 2 on the bead 40. The curl portion 10 has a radius or curvature of about 0.062 inch and has a maximum diameter, at the remote free end of the curl portion 10, of about 1.15 inches. This arrangement facilitates proper positioning of the curl portion 10 of the improved collapsible bag 2 and sandwiching of the curl portion 10 between the bead 40 and the perimeter curl of the mounted cup 32 during a conventional crimping process. In the event that there is inadequate overlap and sandwiching of the curl portion 10 between the bead 40 and the mounting cup 32, the aerosol container 30 may not be adequately sealed and a leak can develop thereby resulting in an inadvertent gradual discharge of a significant portion of the propellant 92.

The neck portion 8 must also have a suitably sized internal diameter so that the neck portion 8 can readily receive a lower pedestal region of the mounting cup 32, when mounted therein during manufacture of the valve, and this receiving feature will be discussed below in further detail with respect to the discussion of the process for manufacturing the aerosol container 30.

The neck portion 8 and the curl portion 10, of the upper sidewall 12, are both devoid of any longitudinally extending pleats 22 while the remainder of the sidewall of the upper section 12, the sidewall of the mid-section 14 and the sidewall of the lower section 16 each include a plurality of continuous longitudinally extending pleats 22, e.g. between 4 and 36 and preferably 16 (please note that only 1 pleat is shown for illustration purposes in FIGS. 1 and 4). Each longitudinally extending pleat 22 is formed Into by alternating longitudinal extending peaks 24 and valleys 26. The longitudinal extending peaks 24 and valleys 26 are all radius and all of the peaks 24 have substantially the same configuration and all of the valleys 26 have substantially the same configuration. Each of the longitudinal extending peaks 24 and each of the longitudinal extending valleys 26 lies in a longitudinally extending plane which passes through a central longitudinal axis A of the improved collapsible bag 2. The longitudinal extending peaks 24 and the longitudinal extending valleys 26 each extend substantially the entire length of the lower section 16 and the mid-section 14 and a lower portion of the upper section 12, except for the neck portion 8 and the curl portion 10.

Figure 5:
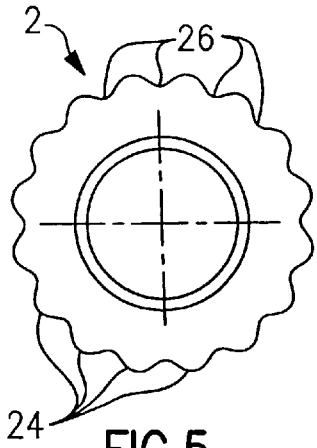
FIG. 5 is a top plan view of FIG. 4.
Figure 6:
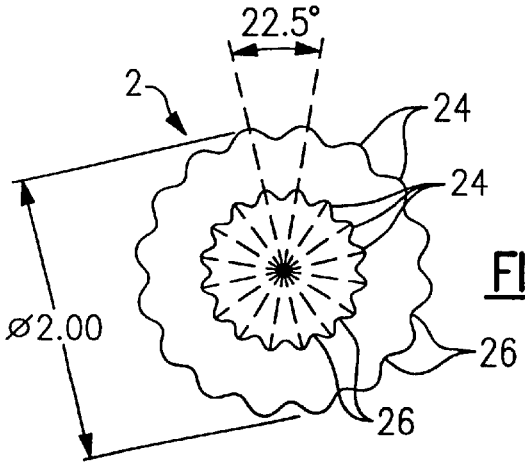
FIG. 6 is a bottom plan view of FIG. 4.

When the deflated improved collapsible bag 2 (see FIGS. 1–3) is inflated with a desired product to be dispensed 18, e.g. shaving cream, the improved collapsible bag 2 expands and assumes the configuration shown in FIGS. 4–6 of the drawings. Tips of all of the longitudinally extending peaks 24 are located at a distance of approximately 1 inch from the central longitudinal axis A of the improved collapsible bag 2 while tips of all of the longitudinally extending valleys 26 are located at a distance of approximately 0.90 inches from the central longitudinal axis A of the improved collapsible bag 2. The longitudinally extending peaks 24, in their expanded state, have a radius of curvature of approximately 0.115 inches while the longitudinally extending valleys 26, in their expanded state, have a radius of curvature of approximately 0.060 inches.

In the deflated state of the improved collapsible bag 2 (see FIGS. 1–3), a pair of longitudinally extending planes, which extend through a pair of adjacent sidewalls joining the longitudinally extending peaks 24 with a common longitudinally extending valley 26, form an angle therebetween of about 40 degrees (see FIG. 3) while, in the inflated state of the improved collapsible bag 2, a pair of longitudinally extending planes, which each extend through an adjacent one of the longitudinally extending peaks 24 and the central longitudinal axis A of the inflated improved collapsible bag 2, form an angle therebetween of about 22.5 degrees (see FIG. 6).

The small radius transition 28, referred to above, is located between the neck portion 8 and the remainder of the upper section 12 of the improved collapsible bag 2. This small radius transition 28 provides a reduced diameter area which separates the opening 4 from a remainder of the improved collapsible bag 2. That is, the inner diameter of the neck portion 8, adjacent the opening, is between 1.035 and 0.930 inch, and most preferably about 0.960 inch, while the inner diameter at the small radius transition 28 is between 0.975 and 0.870 inch and most preferably about 0.91 inch. The exterior radius of curvature of the small radius transition 28 is about 0.065 inch. The purpose of the constriction, formed by the small radius transition 28 in the improved collapsible bag 2, is to facilitate and promote bending of the outwardly tapering sidewall 13 when the improved collapsible bag 2 is filled with a desired product to be dispensed 18. The small radius transition 28 may also assist with providing a partial seal between the inwardly facing surface of the improved collapsible bag 2 and the exterior outwardly facing surface of the valve body 42 to minimize the amount of shaving cream, or some other product to be dispensed 18, which can flow along the exterior surface of the valve body 42 toward the seal formed between the bead 40 and the mounting cup 32.

In the inflated state of the improved collapsible bag 2, the outwardly tapering sidewall 13 of the upper section 12 forms an angle of about 29° with the sidewall 15 of the mid-section 14 while the sidewall 15 of the mid-section 14 forms an angle of about 40° with the inwardly tapering sidewall 17 of the lower section 16. The axial length of the improved collapsible bag 2, when filled with a desired product to be dispensed 18, is approximately 6.8 inches.

Figure 7:
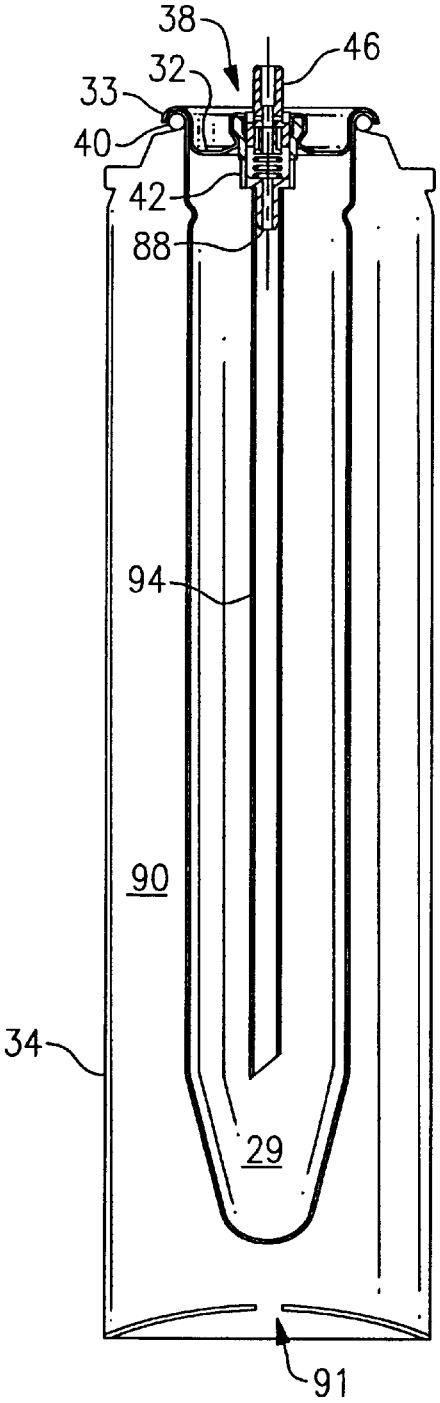
FIG. 7 is a diagrammatic cross-sectional view of an aerosol container, without an actuator button, incorporating the improved collapsible bag according to the present invention with the improved collapsible bag shown in its deflated state prior to being filled with a desired quantity of the product to be dispensed.
Figure 8:
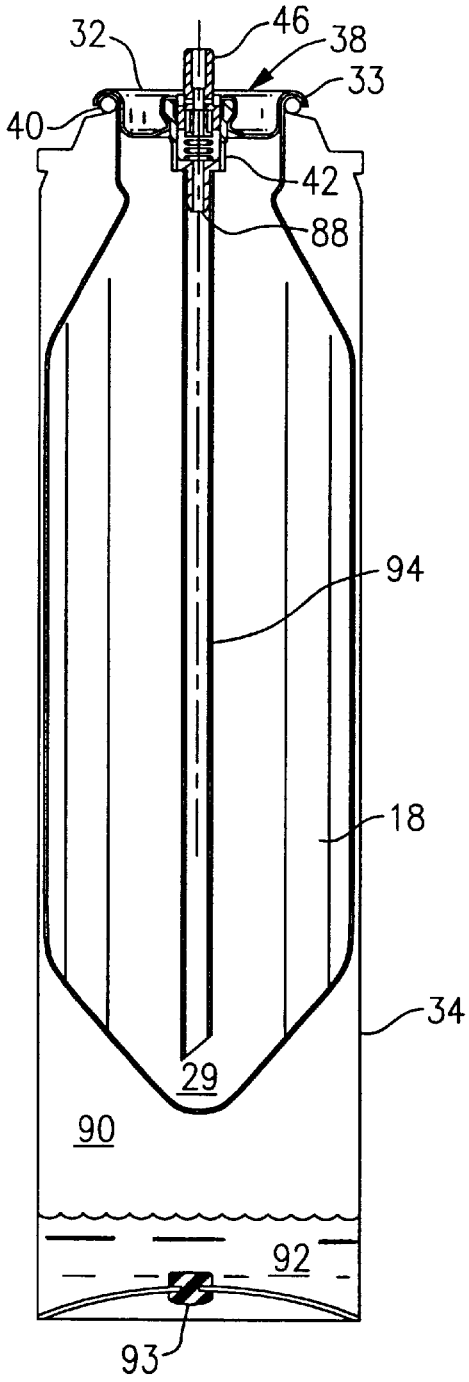
FIG. 8 is a diagrammatic cross-sectional view of an aerosol container, without an actuator button, incorporating the improved collapsible bag according to the present invention with the improved collapsible bag shown in its inflated state after being filled with a desired quantity of the product to be dispensed.

Turning now to FIGS. 7–9, a brief description concerning the various components of the aerosol valve, to be used with the improved collapsible bag 2, will now be briefly discussed. As can be seen in this embodiment, the aerosol container 30 comprises a conventional mounting cup 32 installed on a base container 34. The mounting cup 32 supports an actuator assembly 38. The actuator assembly 38, see specifically FIG. 9, comprises a valve body 42 supporting an upstanding valve stem 46, a biasing spring 48 and a gasket 50. The biasing spring 48 and the gasket 50 are assembled within the valve body 42 and the valve body 42 is clamped or crimped to the mounting cup 32 in a conventional manner by means of a plurality of indentations or crimps 52, e.g. four or six indentations or crimps are formed in the exterior sidewall of the pedestal portion 54 to permanently attach the actuator assembly 38 to the mounting cup 32. The crimping operation forces the valve body 42 slightly upward, relative to the mounting cup 32, to bias and compressively seal the gasket 50 against the inwardly and downwardly facing surface of the mounting cup 32.

A portion of the valve stem 46 protrudes through a central aperture 56 provided in the pedestal portion 54 of the mounting cup 32 and this protruding portion of the valve stem 46 supports an actuator button 44. The actuator button 44 has a central product inlet or aperture 60 therein which receives and snugly fits over an exterior surface of the valve stem 46. The product inlet 60, in turn, communicates with a discharge outlet 64 of the actuator button 44, via a button cavity 66 and at least one radial supply passageway 68.

The valve stem 46 includes a central bore 62 having a dispensing end which communicates with product inlet 60. The opposite end of the central bore 62 communicates with at least one radial orifice 70, and possibly two, three, four or more radial orifices 70 equally spaced about the circumference of the valve stem 26, which are each temporarily blocked from discharging product by a seal formed between the gasket 50 and an annular sealing rib (not shown) when the valve is in its normally spring biased closed position.

When the actuator assembly 38 is sufficiently depressed by an operator, this seal is broken and communication is established between the first radial orifice(s) 70 and the interior cavity 78 of the valve body 42 for discharging the product to be dispensed 18 from the improved collapsible bag 2 of the aerosol container 30, during the dispensing process, to the discharge outlet 64 of the actuator button 44 at a desired product dispensing rate.

The valve body 42 has a thickened mouth 76. The valve body 42 also includes a side wall 80 and a floor wall 82 which is provided with an inlet aperture 84. During the crimping operation with the pedestal portion 54, the plurality of indentations or crimps 52 engage a lower portion of the thickened mouth 76 and force the valve body 42 upwardly so as to compress and seal the gasket 50 against the inwardly and downwardly facing surface of the mounting cup 32.

The valve stem 46 includes an enlarged head 86. The enlarged head 86 is centrally connected to the valve stem 46 at a vertically lower end of the valve element. An annular recess 87 is formed in the undersurface of the enlarged head 86 to receive and center a top portion of the spring 48. The spring 48 is compressibly disposed between the floor 82 and the enlarged head 86 to urge the valve element away from the floor 82 into its elevated normally closed position. The upwardly facing surface of the enlarged head 86 is provided with an annular sealing ring or rib (not shown) which normally seats against the lower or downwardly facing surface of the gasket 50 to form a fluid tight seal therebetween. The radial orifice(s) 70 is located adjacent the enlarged head 86 but is normally closed off by abutting engagement between the annular sealing rib (not shown) with the gasket 50 and by a seal formed between an axially extending sidewall of the gasket 50 and the radial orifice(s) 70, when the valve element is in its elevated normally closed position (see FIG. 9).

A product inlet 88 communicates with an internal cavity 78 of the valve body 42, via the inlet central aperture 84, to supply a product to be dispensed 18 to the valve. If desired, a product dip tube 94 may be fitted over the lower end of the valve body 42 and surround the product inlet 88. A lower end of the product dip tube 94 communicates with the closed end 6 of the improved collapsible bag 2 (see FIG. 7) to facilitate dispensing of the product to be dispensed 18 therefrom as desired.

When an operator desires to dispense product, the above described valve operates in a conventional fashion. Upon initial depression of the actuator, the valve stem 46 compresses the biasing spring 48 which moves the annular sealing rib out of abutting engagement with the gasket 50 and establishes fluid communication between the radial orifice(s) 70 and the internal cavity 78 to allow the product to be dispensed 18 to flow up along and through the dip tube 94, if utilized, into the internal cavity 78, via the inlet central aperture 84. The product to be dispensed 18 then flows between an inwardly facing surface of the valve body 42 and along an outer surface of the enlarged head 86 of the valve stem 46. The product to be dispensed 18 then flows radially through the space formed between gasket 50 and the annular sealing rib and through the radial orifice(s) 70 and along the central bore 62 of the valve stem 46.

Next, the product to be dispensed 18 is then conveyed to the central product inlet or aperture 60 of the actuator button 44 into the button cavity 66. Finally, the product flows along the at least one radial passageway 68 and thereafter is dispensed directly into the atmosphere via the discharge outlet 64 of the actuator button 44.

Prior to sale of the aerosol container 30, the improved collapsible bag 2 is directly received in the opening defined by the bead 40 and the interior space 29 of the improved collapsible bag 2 is filled with a product to be dispensed 18, e.g. shaving cream, while a remaining interior region 90 of the aerosol container 30, located between the exterior surface of the improved collapsible bag 2 and the interior surface of the aerosol container 30, is filled with a suitable quantity of a pressurized gas or propellant 92 to supply the necessary dispensing pressure to the exterior surface of the improved collapsible bag 2 and facilitate dispensing of the product to be dispensed 18 when the operator actuates the aerosol valve.

In order to assemble the aerosol container 30, according to a first embodiment procedure of the present invention, the base of the aerosol container 34 is first assembled in a conventional fashion so as to form a container bottom, a container sidewall and a container top supporting the perimeter bead 40. The perimeter bead 40 defines the opening providing access to the interior region 90 of the aerosol container 30.

The valve assembly is also manufactured in a conventional fashion such that the actuator button 44 will preferably be attached to the valve stem 46 of the actuator assembly during the valve assembly manufacturing process. Likewise, the improved collapsible bag 2 will be manufactured, via conventional blow molding equipment, and supplied to the aerosol container production facility for assembly with a desired aerosol container 30. If desired, the improved collapsible bag 2 may be coupled to the valve assembly by gluing or other conventional and common attachment arrangement so that those two components are combined or assembled with one another and form a single unit.

During assembly of the aerosol container 30, a plurality of container bases 34 are conveyed, via conventional conveying equipment (not shown) to an assembly area. At the assembly area, the improved collapsible bag 2 is placed and received within the opening defined by the bead 40 so that the closed end of the improved collapsible bag 2 is located adjacent the bottom of the aerosol container base 34 and outwardly flaring exterior surface of the perimeter curl portion 10, of the neck portion 8, engages with the exterior surface of the bead 40, of the aerosol container 30. Thereafter, the mounting cup 32, with the attached valve assembly 38 and actuator button 44, is placed over the bead 40 and received within the opening 4 of the improved collapsible bag 2 such that a major portion of the valve assembly 38 is located within the interior cavity 29 of the improved collapsible bag 2 and the perimeter curl portion 10 is sandwiched between the bead 40 and the inwardly facing surface of the curl of the mounting cup 32 (see FIG. 9) during manufacture of the aerosol product.

Once this has occurred, the perimeter curl 33 of the mounting cup 32 is crimped to the bead 40 of the aerosol container 30, in a conventional manner, to permanently attach the mounting cup 32 to the bead 40 and sandwich the curl portion 10 of the improved collapsible bag 2 therebetween. Such crimping forms a fluid tight seal between those two mating components. After this has occurred, the aerosol container 30 is then ready to be filled with a desired product to be dispensed 18 as well as a desired propellant 92.

The unfilled and unpressurized aerosol container 30 is then conveyed to a filling and pressurizing station where the desired product to be dispensed 18 is supplied to the non-pressurized aerosol container 30 via a conventional button-on filling process. During the button-on filling process, the actuator button 44 is sufficiently depressed, by the associated filling equipment, in a conventional manner, such that a first product flow path is established with the interior cavity 29 of the improved collapsible bag 2 via the discharge orifice 64, the radial supply passageway 68, the button cavity 66, central product inlet aperture 60, the central passage 62, and the radial orifice(s) 70, the internal cavity 78, the inlet aperture 84 and the product dip tube 94 (if employed). The filling equipment is operated to dispense a desired quantity of product into the interior cavity 29 and completely fill the improved collapsible bag 2. Once this has occurred, the button-on filling process is discontinued and another aerosol container(s) is then similarly filled. The button-on filling process is repeated at the manufacturing facility as necessary.

Thereafter, a propellant is supplied via a hole 91 opening in the base of the container 34 to the interior region 90 of the aerosol container 30 (see FIG. 7). Once a sufficient supply of propellant is contained within the interior region 90, the filling process ceases and a conventional rubber plug 93, or some other stopper member, is inserted in the hole 91 of the base of the container 34 to seal the hole and prevent propellant from leaking from the aerosol container (see FIG. 8). As such filling process is conventional and fairly well known in the art, a further detailed description concerning the same is not provided.

According to a second embodiment of the present invention, the base of the aerosol container 34 is assembled in a conventional fashion so as to form a container bottom, a container sidewall and a container top supporting the perimeter bead 40. The perimeter bead 40 defines the opening providing access to the interior region of the aerosol container 30.

Likewise, the valve assembly is manufactured in a conventional fashion such that the actuator button 44 will preferably be attached to the valve stem 46 of the actuator assembly during the valve assembly manufacturing process. The improved collapsible bag 2 will also be manufactured, via conventional blow molding equipment, and supplied to the aerosol container production facility for assembly with a desired aerosol container 30. If desired, the improved collapsible bag 2 may be coupled to the valve assembly by gluing or other conventional and common attachment arrangement so that those two components are combined or assembled with one another and form a single unit.

During assembly of the aerosol container 30, a plurality of container bases 34 are conveyed along via conveying equipment to an assembly area. At the assembly area, the improved collapsible bag 2 is placed and received within the opening defined by the bead 40 so that the closed end of the improved collapsible bag 2 is located adjacent the bottom of the aerosol container base 34 and outwardly flaring exterior surface of the perimeter curl portion 10, of the neck portion 8, engages with the exterior surface of the bead 40, of the aerosol container 30. Thereafter, the mounting cup 32, with the attached valve assembly 38 and actuator button 44, is placed over the bead 40 and received within the opening 4 of the improved collapsible bag 2 such that a major portion of the valve assembly 38 is located within the interior cavity 29 of the improved collapsible bag 2 and the perimeter curl portion 10 is sandwiched between the bead 40 and the inwardly facing surface of the curl of the mounting cup 32 (see FIG. 9) during manufacture of the aerosol product.

Next, the improved collapsible bag 2, the mounting cup 32, the attached valve assembly 38 and the actuator button 44 are all engaged with the associated under-the-cup filling equipment in a conventional manner. The interior region 90 of the aerosol container 30 is then filled with a desired quantity of a propellant 92 and then the improved collapsible bag 2, the mounting cup 32, the attached valve assembly 38 and the actuator button 44 are all lowered, via the associated under-the-cup filling equipment, into the opening of the bead 40 so that the closed end of the improved collapsible bag 2 is located adjacent the bottom of the aerosol container base 34 and outwardly flaring exterior surface of the perimeter curl portion 10, of the neck portion 8, engages with the exterior surface of the bead 40, of the aerosol container 30. Thereafter, the perimeter curl 33 of the mounting cup 32 is crimped to the bead 40 of the aerosol container 30, in a conventional manner, to permanently attach the mounting cup 32 to the bead 40 and sandwich the curl portion 10 of the improved collapsible bag 2 and form a fluid tight seal between those two mating components. Once this has occurred, the aerosol container 30 is adequately pressurized and then ready to be filled with a desired product to be dispensed 18 as well as a desired propellant 92.

The pressurized aerosol container 30 is then conveyed to a filling station where the desired product to be dispensed 18 is supplied to the pressurized aerosol container 30 via a conventional button-on filling process. During the button-on filling process, the actuator button 44 is sufficiently depressed, by the associated filling equipment in a conventional manner, such that a first product flow path is established with the interior cavity 29 of the improved collapsible bag 2 via the discharge orifice 64, the radial supply passageway 68, the button cavity 66, central product inlet aperture 60, the central passage 62, and the radial orifice(s) 70, the internal cavity 78, the inlet aperture 84 and the product dip tube 94 (if employed). The filling equipment is operated to dispense a desired quantity of product into the interior cavity 29 and completely fill the improved collapsible bag 2. Once this has occurred, the button-on filling process is discontinued and another aerosol container is then similarly filled. The process is repeated at the manufacturing facility as necessary.

It is to be appreciated that a conventional button-off filling process could also be employed, if desired, instead of a button-on filling process, and after filling of the aerosol containerwith the product to be dispensed, via the button-off filling process, the actuator is then installed on the valve stem in a conventional fashion. If a button-off filling process is utilized, the actuator is supplied to the aerosol manufacturing facility separately from a remainder of the valve assembly.

Since certain changes may be made in the above described improved collapsible bag, an aerosol container utilizing the improved collapsible bag and a method of assembling an aerosol container with the improved collapsible bag, without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. An improved collapsible bag for containing a product to be dispensed from an aerosol container, the improved collapsible bag having an opening at one end and being closed at an opposite end, the improved collapsible bag comprising:

an upper section including a cud portion, a neck portion and an outwardly tapering section, and the outwardly tapering section tapering outwardly in an inflated state of the improved collapsible bag;

a mid-section contiguous with the outwardly tapering section, the mid-section being generally cylindrical in shape;

a lower section contiguous with the mid-section and defining the closed end of the improved collapsible bag, and the lower section tapering inwardly in an inflated state of the improved collapsible bag;

at least the curt portion of the upper section having a sufficient first wall thickness to facilitate a fluid tight seal between a bead and a perimeter curl of a mounting cup during assembly of an aerosol valve, the outwardly tapering section, the mid-section and the lower section having a second wall thickness less than the first wall thickness to facilitate insertion of the improved collapsible bag into the aerosol container during assembly, to promote collapse of the improved collapsible bag during dispensing of the product to be dispensed, and to facilitate substantially complete dispensing of the product from the improved collapsible bag; and a small radius transition between the neck portion and the outwardly tapering section having a sufficiently sized minimum inner diameter so that the small radius transition is spaced from an exterior surface of an actuator assembly when the mounting cup is secured to the curl portion of the improved collapsible bag, the small radius transition has a gradual transition from the first wall thickness to the second wall thickness, the small radius transition provides a reduced diameter area which partially separates the opening from the remainder of the improved collapsible bag, and the small radius transition promotes bending of the outwardly tapering section when the improved collapsible bag is filled with the desired product to be dispensed.

2. The improved collapsible bag according to claim 1, wherein the mid-section and the lower section and a portion of the upper section are all provided with a plurality of longitudinally extending pleats, and each one of the longitudinally extending pleats is formed by alternate longitudinally extending peaks and valleys.

3. The improved collapsible bag according to claim 2, wherein the neck portion and the curl portion of the upper section are devoid of the longitudinally extending peaks and devoid of the longitudinally extending valleys.

4. The improved collapsible bag according to claim 3, wherein the longitudinally extending peaks, in an inflated state of the improved collapsible bag, have a radius of curvature of approximately 0.115 inch while the longitudinally extending valleys, in an inflated state of the improved collapsible bag, have a radius of curvature of approximately 0.060 inch.

5. The improved collapsible bag according to claim 1, wherein the neck portion has an outer diameter of about 1.035 inches and an inner diameter of about 0.930 inches, the curl portion has an outerdiameter of about 1.15 inches and the small radius transition has a minimum inner diameter of about 0.87 of an inch.

6. The improved collapsible bag according to claim 1, wherein the improved collapsible bag, in a deflated state thereof, has an axial length of about 7.5 inches and, in an inflated state thereof, has an axial length of about 6.8 inches and at least the curl portion and the neck portion have the first wall thickness which is about 0.015 of an inch while the second wail thickness of a remnainder of the upper section, the mid-section and the lower section is about 0.006 of an inch.

7. The improved collapsible bag according to claim 1, wherein, in an inflated state of the improved collapsible bag, the outwardly tapering section forms an angle of about 29° relative to the mid-section and the lower section tapering inwardly to form angle of about 40° relative to the mid-section.

8. An aerosol container comprising a base container defining an annular bead; an improved collapsible bag for containing a product to be dispensed from the aerosol container, the improved collapsible bag having an opening at one end and being closed at an opposite end, the closed end of the improved collapsible bag being received within the base container and the open end of the improved collapsible bag having a curl portion which engages the annular bead of the base container to support the improved collapsible bag within the base container; an actuator assembly supporting an actuator button, the actuator assembly being crimped to a mounting cup, and the mounting cup, supporting the actuator assembly and the actuator button, being crimped to the bead of the base container, following placement of the mounting cup over the improved collapsible bag and the base container, to form the aerosol container;

the improved collapsible bag comprising:

an upper section including the curl portion, a neck portion and an outwardly tapering section, and the outwardly tapering section tapering outwardly in an inflated state of the improved collapsible bag;

a mid-section contiguous with the outwardly tapering section, the mid-section being generally cylindrical in shape;

a lower section contiguous with the mid-section and defining the closed end of the improved collapsible bag, and the lower section tapering inwardly in an inflated state of the improved collapsible bag;

at least the curl portion of the upper section having a sufficient first wall thickness to facilitate a fluid tight seal between said annular bead and a perimeter curl of the mounting cup during assembly of an aerosol valve, the outwardly tapering section, the mid-section and the lower section having a second wall thickness less than the first wall thickness to facilitate insertion of the improved collapsible bag into the aerosol container during assembly, to promote collapse of the improved collapsible bag during dispensing of the product to be dispensed, and to facilitate substantially complete dispensing of the product from the improved collapsible bag; and a small radius transition between the neck portion and the outwardly tapering section having a sufficiently sized minimum inner diameter so that the small radius transition is spaced from an exterior surface of the actuator assembly when the mounting cup is secured to the curl portion of the improved collapsible bag, the small radius transition has a gradual transition from the first wall thickness to the second wail thickness, the small radius transition provides a reduced diameter area which partially separates the opening from the remainder of the improved collapsible bag, and the small radius transition promotes bending of the outwardly tapering section when the improved collapsible bag is filled with the desired product to be dispensed.

9. The aerosol container according to claim 8, wherein the actuator assembly comprises a valve body supporting a spring for urging an upstanding valve element against a gasket to form a fluid tight seal, a valve housing having an inlet aperture to facilitate communication between an interior of the improved collapsible bag and an internal cavity of the valve housing, and the upstanding valve element having at least one radial orifice and a central bore to facilitate passage of the product to be dispensed therealong to a discharge outlet of the actuator button when the upstanding valve element is sufficiently spaced away from the gasket against the bias of the spring to supply product to the actuator,button for discharge to an exterior environment.

10. The aerosol container according to claim 9, wherein the wall of the mid-section and the wall of the lower section and a portion of the wall of the upper section, of the improved collapsible bag, are all provided with a plurality of longitudinally extending pleats, and each one of the longitudinally extending pleats is formed by alternate longitudinally extending peaks and valleys and the neck portion and the curl portion of the upper section of the improved collapsible bag are devoid of the longitudinally extending peaks and the longitudinally extending valleys.

11. The aerosol container according to claim 9, wherein the improved collapsible bag, in a deflated state thereof, has an axial length of about 7.5 inches and, in an inflated state thereof, has an axial length of about 6.8 inches; and the first wall thickness of at least the curl portion and the neck portion of the improved collapsible bag is 0.015 of an inch while the second wall thickness of a remainder of the upper section, the mid-section and the lower section is about 0.006 of an inch.

12. The aerosol container according to claim 8, wherein, in an inflated state of the improved collapsible bag, the wall forming the outwardly tapering section forms an angle of about 29° with the wall forming the mid-section and the inwardly tapering wall of the lower section form an angle of about 40° with the wall of the mid-section;

the neck portion has an outer diameter of about 1.0 inches and an inner diameter of about 0.97 inches, the curl portion has an outer diameter of about 1.15 inches and the small radius transition has a minimum inner diameter of about 0.87 of an inch.

* * * * *